US005397979A

United States Patent [19]

Yamamoto

[11] Patent Number: 5,397,979

[45] Date of Patent: Mar. 14, 1995

[54] INTEGRATED CIRCUIT WITH CONSTANT-VOLTAGE CONTROL CIRCUIT

[75] Inventor: Kenji Yamamoto, Kyoto, Japan

[73] Assignee: Rohm Co., Ltd., Kyoto, Japan

[21] Appl. No.: 953,525

[22] Filed: Sep. 29, 1992

[30] Foreign Application Priority Data

Sep. 30, 1991 [JP] Japan ..... 3-278739

[51] Int. Cl.[6] ..... G05F 1/40; G05F 1/44

[52] U.S. Cl. ..... 323/281

[58] Field of Search ..... 323/281, 284, 292, 303, 323/320

[56] References Cited

U.S. PATENT DOCUMENTS 4,827,205 5/1989 Hafner, Jr. et al. ..... 383/281

*Primary Examiner*—Steven L. Stephan
*Assistant Examiner*—E. To
*Attorney, Agent, or Firm*—Brumbaugh, Graves, Donohue & Raymond

[57] ABSTRACT

While a current control circuit is arranged outside an integrated circuit, a voltage detection circuit, a reference voltage generating circuit and an error amplifier circuit of a feedback system supplied with output voltage V via a terminal, together with a signal processing circuit, are integrated and miniaturized in the integrated circuit 103. Moreover, a terminal 103 is provided in order to connect a capacitor C from the outside. The output voltage V is stabilized by stabilizing a reference voltage signal R further to ensure high-precision signal processing. Thereby, an integrated circuit is provided incorporating a constant-voltage control circuit fit for precise signal processing even when only power at a voltage exceeding the withstand voltage of an integrated circuit is supplied and the integrated circuit is at the same time capable of contributing to the miniaturization of an apparatus in which it is used.

2 Claims, 2 Drawing Sheets

INTEGRATED CIRCUIT WITH CONSTANT-VOLTAGE CONTROL CIRCUIT

BACKGROUND OF THE INVENTION

1. Field of The Invention

The present invention relates to an integrated circuit incorporating a constant-voltage control circuit and more particularly to an integrated circuit which incorporates part of a constant-voltage circuit and is suitable for use in such an environment that supply voltage exceeds withstand voltage in the elements of the integrated circuit.

2. Description of Conventional Art

Along with attempts to make products small in size, there has developed a persistent demand for their circuit miniaturization. In order to meet such a demand, efforts are also being made to microminiaturize integrated circuits recently. As a result, circuits such as data processing circuits and signal processing circuits including those which are considerably complicated in construction have been integrated into one-chip integrated circuits. The signal processing circuit on the periphery of the recording head of a video tape recorder, for instance, is seen to demonstrate the feasibility of integration into an integrated circuit as far as that circuit portion is concerned.

In this case, most of the portion requiring space in the circuit is occupied by a drive circuit for driving mechanical parts such as a head and the most supply power is also consumed by the drive circuit.

Therefore, voltages fit for use in the drive circuit, for instance, 12 V, 24 V and so on, are necessarily used as those of the supply power in such an environmental condition on one hand, and voltages to be supplied to an integrated circuit have to be within a range of voltages lower than the maximum rated voltage in the process employed because the withstand voltage of the signal processing IC is reduced as the integration of the internal microminiaturized elements increases.

Two kinds of power supplies are thus necessitated since the supply voltage intended for the signal processing IC differs from what is intended for the drive circuit. However, it is still uneconomical to provide an individual power supply for each integrated circuit designed to consume trivial power. For this reason, the practice often followed to cope with the inconvenience is to employ a constant-voltage circuit for locally generating the power intended for the signal processing IC from the power supply intended for the drive circuit, whereby a single power supply is made useful without causing problems by supplying the power thus locally generated to the signal processing IC.

FIG. 2 is a block diagram of a conventional constant-voltage circuit for use in the case stated above.

In FIG. 2, numeral 1 denotes a current control circuit; 2, a voltage detection circuit; 3, a reference voltage generating circuit; 4, a differential circuit; 5, an amplifier circuit; and 6, an error amplifying circuit.

The current control circuit 1 receives power at unregulated voltage to be supplied to the aforementioned drive circuit or power at what is equivalent thereto as an input voltage U and generates power at an output voltage V by controlling the resulting current by means of a control element such as a transistor, and supplying the power at the voltage thus reduced to a smoothing capacitor. On receiving a feedback control signal D at this time, the current control circuit 1 increases and decreases the quantity of the current in response to the control signal D in order to control the output voltage V.

On receiving the output voltage V, the voltage detection circuit 2 generates a detection signal A having a waveform which accords with the output voltage V by means of resistance division.

The reference voltage generating circuit 3, which comprises a Zener diode, for instance, generates a reference voltage signal R for determining a target control value of the output voltage V.

On receiving the detection signal A and the reference voltage signal R, the differential circuit 4 in the error amplifier circuit 6, which comprises the differential circuit 4 and the amplifier circuit 5, discriminates between the detection signal A and the reference voltage signal R, and generates an error signal B. On receiving the error signal B, the amplifier circuit 5 amplifies the signal while converting it to a current signal suitable for driving the transistor of the current control circuit 1, and feeds back the amplified signal to the current control circuit 1 as the control signal D.

The power at the output voltage V thus reduced from the input voltage U is controlled by the feedback system operating in such a way that any change of the voltage value from the target value predetermined by the reference voltage signal R is offset. Consequently, the output voltage is held constant at all times.

Provided the constant voltage circuit together with the signal processing IC which requires such a low voltage power supply is locally installed, it is unnecessary to provide two power supply systems which is uneconomic.

Presently, so-called three-terminal regulators with a conventional constant-voltage circuit integrated into one chip have been put on the market and they are available for use at low prices.

However, these products sold on the market are intended for general purpose and not applicable to precision signal processing circuits for video tape recorders and the like because they are hardly capable of removing input noise and ripple components.

Nevertheless, the constant-voltage circuit constructed of discrete parts becomes too complicated to be packaged and still poses a problem as a demand for miniaturizing the apparatus cannot be met.

SUMMARY OF THE INVENTION

An object of the present invention made to solve the foregoing problems in the conventional art is to provide an integrated circuit incorporating a constant-voltage control circuit fit for precise signal processing even in such an environment that only power at a voltage exceeding the withstand voltage of an integrated circuit is supplied and at the same time capable of contributing the miniaturization of an apparatus.

In order to accomplish the object stated above, an integrated circuit incorporating a constant-voltage control circuit according to the present invention comprises a first terminal, a second terminal, a third terminal, a voltage detection circuit, a reference voltage generating circuit and a differential amplifier circuit, wherein the first terminal receives power at a second voltage from an external current control circuit for generating the power at the second voltage which is lower than a first voltage by controlling the current in response to a control signal on receiving power at the first voltage and wherein control is exerted to make the second voltage a predetermined constant voltage by supplying the control signal from the second terminal to the current control circuit, whereby power at the predetermined constant voltage is caused to be generated at the first terminal, the voltage detection circuit generating by means of resistance division a detection signal whose waveform accords with the second voltage on receiving the second voltage via the first terminal, the reference voltage generating circuit generating a reference voltage signal for determining a target control value of the second voltage in accordance with a smoothing circuit such as a capacitor connected to the third terminal, and supplying the reference voltage signal to the differential amplifier circuit, and the differential amplifier circuit amplifying the difference between these signals on receiving the detection signal and the reference voltage signal, and supplying the difference thus amplified to the second output terminal as the control signal.

In the integrated circuit incorporating the constant-voltage circuit thus constructed according to the present invention, the power at the input voltage, that is, at the voltage exceeding the withstand voltage of the elements in the integrated circuit is not directly received at the first terminal but the power at the output voltage reduced by the external current control circuit is received thereby. When the control signal is used to control the external current control circuit, moreover, the control is normally exerted via a current limit resistor or a current/voltage conversion resistor and consequently the voltage of the input power is not directly received but the voltage reduced by the resistor or the like is received by the second terminal and the circuit element for driving the control signal. Since the third terminal is used to connect the smoothing circuit with the reference voltage signal generated in the integrated circuit, it receives only what is lower than the withstand voltage as well.

With this arrangement, the voltage detection circuit, the reference voltage generating circuit and the error amplifier circuit need not have a high withstand voltage. It is therefore possible to integrate these circuits, including the voltage detection circuit, the reference voltage generating circuit and the error amplifier o circuit, together with other signal processing circuits, into one integrated circuit. The fact that the number of parts can be decreased substantially results in reducing the size of these circuits and the apparatus itself even when they are used in such an environment that power is supplied only at a voltage exceeding the withstand voltage of the integrated circuit.

Since the reference voltage signal line is connected to the third terminal, moreover, the aforementioned output voltage, that is, the supply voltage intended for the circuits in the integrated circuit can be stabilized in accordance with the signal processing precision required by externally fitting the terminal to the smoothing circuit (e.g., smoothing capacitor) so as to stabilize the voltage of the reference voltage signal. As a result, the operation of the signal processing circuit in the integrated circuit is stabilized, so that highly precise signal processing can be performed.

DETAILED DESCRIPTION OF THE PREFERRED EMBODIMENT

Figure 1:
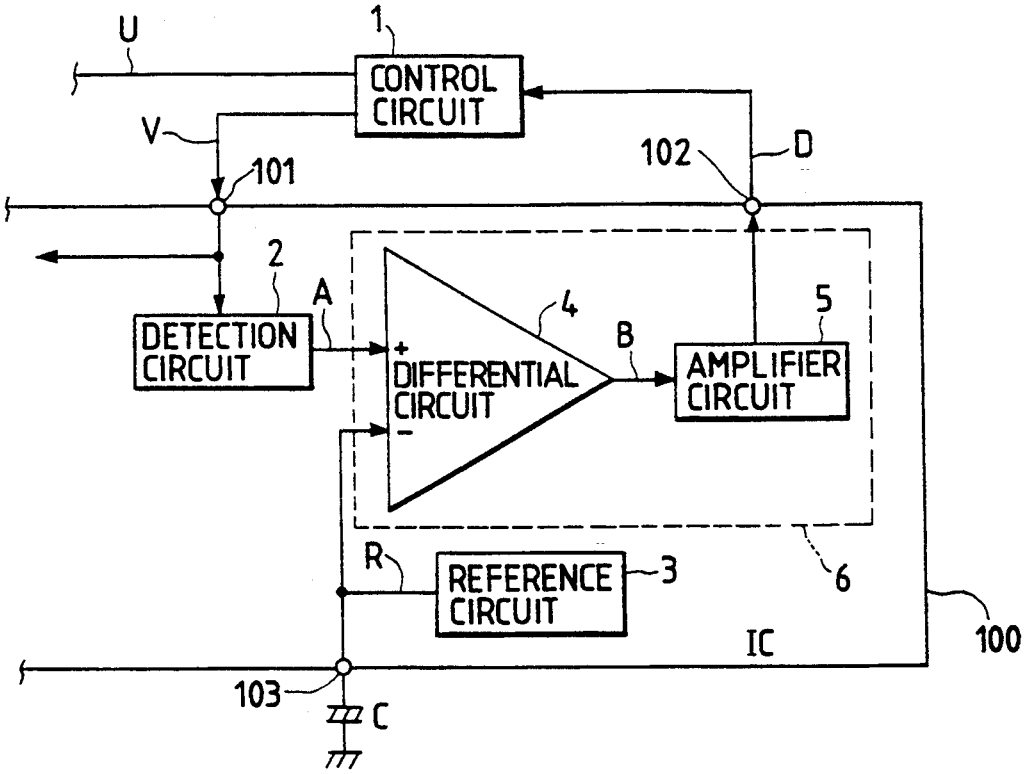
FIG. 1 is a block diagram of an integrated circuit incorporating a constant-voltage control circuit according to the present invention.
Figure 2:
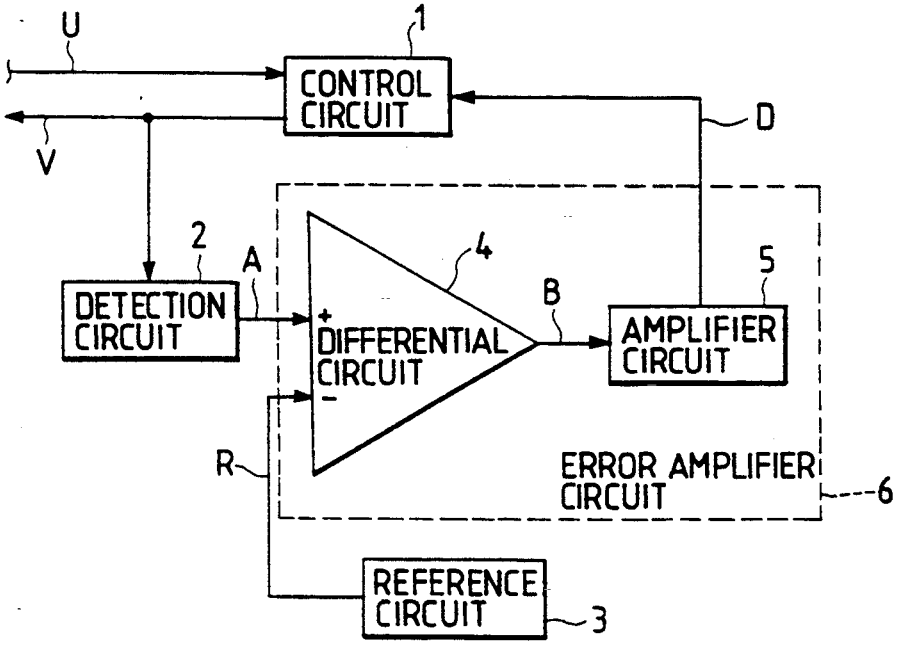
FIG. 2 PRIOR ART
FIG. 2 is a block diagram of a conventional constant-voltage circuit.

A description will subsequently be given of an integrated circuit incorporating a constant-voltage control circuit embodying the present invention. FIG. 1 is a block diagram illustrating a circuit arrangement in this embodiment corresponding to the conventional arrangement of FIG. 2.

Figure 4:
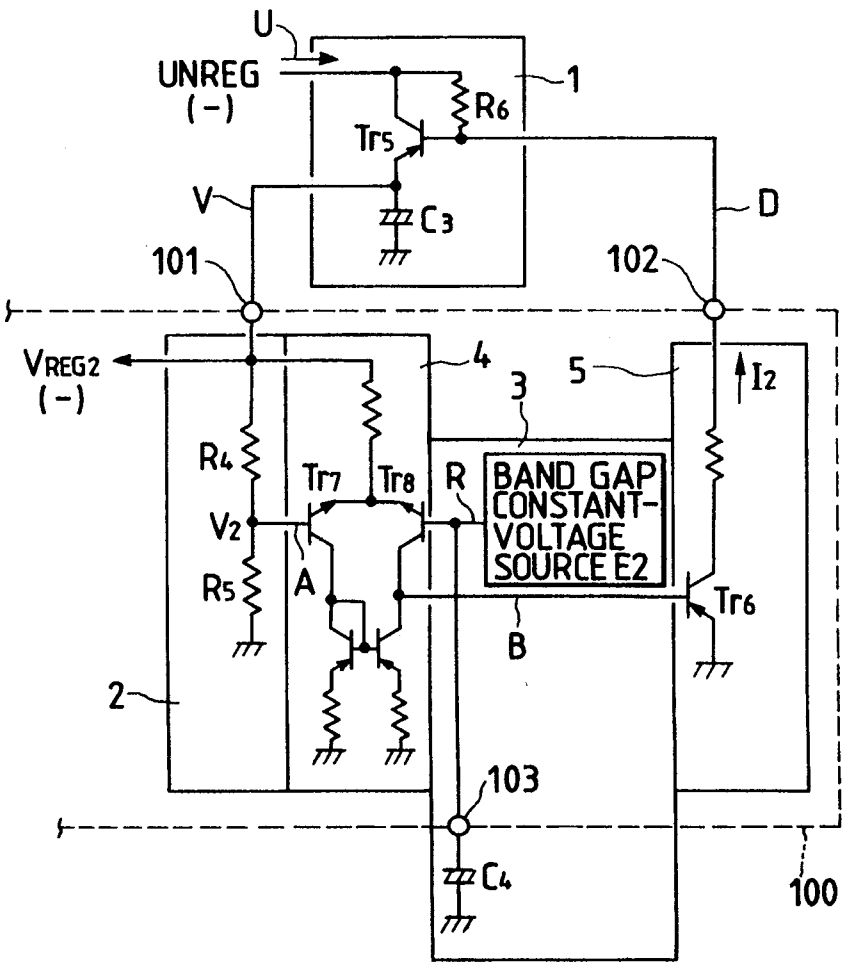
FIG. 4 is a detailed block diagram of an integrated circuit incorporating a constant-voltage control circuit corresponding to a negative power supply.
Figure 3:
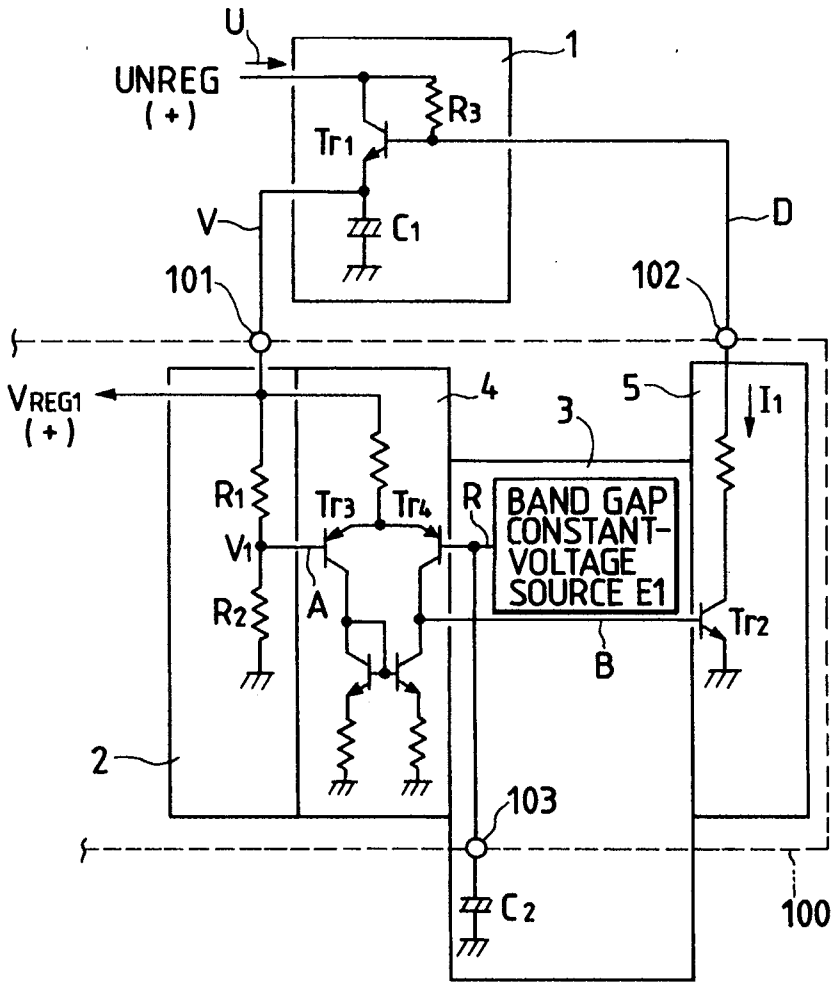
FIG. 3 is a detailed block diagram of an integrated circuit incorporating a constant-voltage control circuit corresponding to a positive power supply.

FIGS. 3, 4 are detailed versions of FIG. 1: FIG. 3 is a detailed diagram corresponding to a positive power supply; and FIG. 4 is a detailed diagram corresponding to a negative power supply.

In these drawings, numeral 1 denotes a current control circuit; 2, a voltage detection circuit; 3, a reference voltage generating circuit; 4, a differential circuit; 5, an amplifier circuit; 6, an error amplifier circuit; 100, an integrated circuit incorporating a constant-voltage control circuit (excluding signal processing circuitry, however), and 101, 102, 103 terminals of the integrated circuit 100.

The current control circuit 1 receives power at unregulated voltage to be supplied to the conventional drive circuit or power at what is equivalent thereto as input voltage UNREG (+) (or UNREG (−)), generates power at output voltage V by controlling the current resulting from the power at the input voltage U by means of a control element such as a transistor Tr1 (or Tr5) and supplying the power at the voltage thus reduced to a smoothing capacitor C1 (C3), and supplies the power thus generated via the terminal 101 to the integrated circuit 100.

When a feedback control signal D from the terminal 102 is received at the base of the transistor Tr1 (or Tr5), the current control circuit 1 increases and decreases the quantity of the current in response to the control signal D in order to control the output voltage V.

The current control circuit 1 is arranged outside the integrated circuit 100 as it directly receives the supply power at the voltage UNREG (+) (or UNREG (−)) exceeding the withstand voltage of the integrated circuit 100.

On receiving the output voltage V, the voltage detection circuit 2 generates a detection signal A having a waveform which accords with the output voltage V by means of resistance division using resistors R1, R2 (or R4, R5).

The reference voltage generating circuit 3, which comprises a band gap constant-voltage source E1 (or E2) having stable characteristics, generates a reference voltage signal R for determining a target control value of the output voltage V.

The reference voltage signal R is further smoothed and stabilized by an external capacitor C2 (or C1) connected to the terminal 103.

On receiving the detection signal A and the reference voltage signal R, the differential circuit 4 in the error amplifier circuit 6, which comprises the differential circuit 4 provided with transistors Tr3, Tr4, (or Tr7, Tr8), for instance, and the amplifier circuit 5 provided with a transistor Tr2 (or Tr6), for instance, discriminates between the detection signal A and the reference voltage signal R, and generates an error signal B. On receiving the error signal B, the amplifier circuit 5 amplifies the signal while converting it to a current signal I1 (or I2) fit for driving the transistor Tr1 (or Tr5) of the current control circuit 1, and feeds back the amplified signal via the terminal 102 to the current control circuit 1 as the control signal D.

The voltage applied to the terminal 102 then is the sum of the output voltage V and the base-to-emitter voltage (about 0.6 V) of the transistor Tr1 (or Tr5), whereas the voltage applied to the transistor Tr2 (or Tr6) is lower than the withstand voltage of the transistor Tr2 (or Tr6) since the former is lower by a voltage drop resulting from the resistance because of the current signal I1 (or I2).

The power at the output voltage V thus reduced from the input voltage U is controlled by the feedback system operating in such a way that any change of the voltage value from the target value predetermined by the reference voltage signal R is offset. Consequently, the output voltage is held constant at all times.

As most of the voltage control of the constant-voltage circuit is thus integrated in the integrated circuit for signal processing by utilizing the fact that this feedback system is complete with one kind of signal processing, only a small portion of the control circuit is formed with discrete elements.

As will be understood from the description above, the larger part of the voltage control of the constant-voltage circuit excluding the circuit to which high voltage is directly applied in the integrated circuit incorporating a constant-voltage control circuit is integrated into a one-chip integrated circuit. Together with the provision of the terminal for smoothing the reference voltage, the integrated circuit incorporating a constant-voltage control circuit is employed for an apparatus such as a video tape recorder or the like having a circuit portion to which only power at a voltage exceeding the withstand voltage of the integrated circuit is supplied, so that it is made possible to supply power with great stability which enables precision signal processing to be performed unlike the three-terminal regulators sold on the market. With the integration thus accomplished, voltage exceeding the set constant voltage is not applied to the integrated circuit even when any microminiaturized process low in withstand voltage is employed, whereby the freedom of the voltage supplied from the outside is increased, irrespective of the absolute maximum rating of the integrated circuit. Moreover, the present invention has the effect of contributing to the miniaturization of apparatus as discrete parts for use in the control circuit and like can be decreased and readily packaged.

What is claimed is:

1. A voltage control arrangement comprising an integrated circuit having a low withstand voltage and having first, second and third terminals and incorporating a constant-voltage control circuit, and an external current control circuit which receives an input voltage which is higher than the withstand voltage of the integrated circuit and generates a regulated voltage lower than said input voltage in response to a control signal and supplies the regulated voltage to the first terminal of the integrated circuit, said integrated circuit comprising:

a voltage detection circuit for generating a detection signal whose waveform accords with said regulated voltage of said current control circuit received at the first terminal of the integrated circuit;

a reference voltage generating circuit for generating a reference voltage signal to determine a target value of said regulated voltage in accordance with an external smoothing circuit, which is connected to said reference voltage generating circuit through the second terminal of the integrated circuit; and an error amplifying circuit for amplifying a difference between said detection signal and said reference voltage signal, and supplying the difference thus amplified to said external current control circuit as said control signal through the third terminal of the integrated circuit.

2. A constant-voltage control circuit comprising:

an external current control circuit receiving an input voltage which is higher than the withstand voltage of an integrated circuit and generating a regulated voltage lower than said input voltage in response to a control signal;

and an integrated circuit separate from the external current control circuit comprising:

a voltage detection circuit for generating a detection signal whose waveform accords with said regulated voltage of said current control circuit;

a reference voltage generating circuit for generating a reference voltage signal to determine a target value of said regulated voltage in accordance with an external smoothing circuit, which is connected to said reference voltage generating circuit; and an error amplifying circuit for amplifying a difference between said detection signal and said reference voltage signal, and supplying the difference thus amplified to said external current control circuit as said control signal.

* * * * *